United States Patent [19]

Lung

[11] 4,128,417

[45] Dec. 5, 1978

[54] PROCEDURE FOR THE PREPARATION OF REFINED MATERIALS CONTAINING SiC AND/OR FeSi

[76] Inventor: Bernhard Lung, Wörtelstrasse 2, D-7554 Kuppenheim, Fed. Rep. of Germany

[21] Appl. No.: 826,269

[22] Filed: Aug. 19, 1977

[30] Foreign Application Priority Data

Aug. 25, 1976 [DE] Fed. Rep. of Germany ..... 2638117

[51] Int. Cl.[2] ..... C22C 1/00; C22B 1/08

[52] U.S. Cl. ..... 75/129; 75/3

[58] Field of Search ..... 75/129, 3

[56] References Cited

U.S. PATENT DOCUMENTS 4,022,615 5/1977 Wells ..... 75/3

*Primary Examiner*—P. D. Rosenberg

*Attorney, Agent, or Firm*—Craig & Antonelli

[57] ABSTRACT

The invention relates to a method of preparing SiC or FeSi-containing materials, or mixtures thereof, having a grain size of less than 0.2mm to form metallurgically adjustable silicon bearers by binding with an hydraulic binding agent, wherein a mix of SiC and/or FeSi-containing fine materials, an hydraulic binding agent, and other silicon-containing materials of a grain size greater than 0.2mm is compressed and is subsequently hardened in a saturated steam atmosphere.

11 Claims, No Drawings

REFINED MATERIALS CONTAINING SiC AND/OR FeSi

The invention concerns a process for the preparation of SiC and/or FeSi-containing fine materials with a grain size smaller than 0.2mm to form metallurgically adjustable silicon bearers by binding with a hydraulic binding agent.

In certain metallurgical processes, e.g. in the cupola furnace or with the LD process, it is necessary to feed in the silicon melts which occur in the form of silicon bearers, e.g. as silicon carbide or ferrosilicon, separately or as mixtures.

Metallurgical silicon carbide is obtained in SiC melting operations with a purity grade of approximately 85 to 94% SiC. Moreover, the silicon-carbide-containing scrap materials, e.g. grinding wheel fragments or disc or capsule fragments are employed as silicon bearers.

For the silification of cast iron melts in the cupola furnace, in practice, ferrosilicon, metallurgical SiC from the SiC melting operations or the aforementioned SiC-containing scrap materials in varying mixing proportions are used as Si bearers. These Si-bearers, in the grain form mentioned, are bound with the addition of water, with a hydraulic binding agent, e.g. cement or chalk and, if necessary, further aggregates, and compressed into so-called packs, (briguettes). For this the vibration process known in the Concrete Industry (German Patent Spec. No. 15 83 262) is employed.

In various melting processes in the Iron and Steel Industry, e.g. in the LD (I.P.) process, metallurgical SiC or SiC-containing scrap materials or Ferrosilicon in large grain sizes, e.g. from 10–20 and/or 10–80 mm are put directly into the converter as Si-bearers.

Not only with cupola furnaces, but also with the aforementioned processes, the Si-bearers must be present as briquettes or in large pieces as, for example, the product of a fine grain material subjected to high pressure. Perfect feed for the furnace for the best possible Si yield without previous reaction might not be obtained, and the Si processing loss would be too high.

From concrete technology it is known that, for the necessary crushing strength of concrete slabs, an additional admixture of fine material besides the hydraulic binding agent is only possible to a limited extent. The amount of additional material, in the aforementioned briquettes, is in the region of 20% with material finenesses up to a maximum grain size of 0.2mm. With the use of ceramic bound SiC scrap materials, the amount of additional material is further limited because of the small SiC content of the fine material and the bad wettability with water resulting from the presence of the ceramic binding material, there being a correspondingly increased cement requirement.

Not only with the manufacture of ferrosilicon and silicon carbide, but also with the mechanical and thermic regeneration of silicon carbide-containing grinding wheels and sintering adjuvant scrap, large volumes of Si-containing fine materials are available. These Si-containing fine materials are accumulated automatically directly in production, e.g. in screening plants or by exhaust from these processes through cyclones or filters, in a grain size ranging from approximately 0–0.2mm. Through statutory rules in the last few years, the obligatory yield of these Si-containing dusts has risen considerably.

This important quantity of yielded Si-dust material has, up to now, only been economically utilized in a limited volume. The largest portion by far, produces waste product that is not used. The possibility of using the dust material for metallurgical processes is only possible in the limited volume mentioned above.

The object of the invention is to provide a use, as Si-bearers for metallurgical processes, for these Si-containing fine materials inevitably obtained in melting processes and in the regeneration of SiC-containing materials.

This object is achieved, according to the present invention, wherein a moist mix of 30–85% SiC or FeSi-containing fine materials, or a mixture thereof, 10–15% hydraulic binding agent, the remaining silicon-containing fractions having a grain size larger than 0.2mm, is compressed at a pressure greater than 300 bp/cm$^2$ and the compressed mix is subsequently hardened in a saturated steam atmosphere above 100 bp/cm$^2$ at a temperature above 100° C. As a rule, cement or chalk are used as hydraulic binding agent.

Practical tests have shown that, in this way, Si-bearers of various forms and sizes can be manufactured, with varying Si-proportion which, according to a hardening time of 4 to 8 hours, acquire a sufficient compression - and breaking strength so that, as Si-bearers, they can be put into the cupola furnace. Manufacture of a briquette with uniform useful content can readily be obtained.

It has further been found that particular granular distribution is not necessary, nor is the proportion of Si-containing fine material critical. It is not necessary to use material of any particular particle size range. Random granulations of, e.g. 0–10mm with excess proportion of a SiC or FeSi-containing dust can be processed.

The ceramic binder content of SiC-containing scrap materials has not been found to be detrimental. Because of the small amount of water required in the mixing process of this method, and the reduced pore construction of the product, the compression strength of the compound is consequently raised.

The cement utilization is considerably more advantageous in comparison with the customary briquette manufacture. The same strength as in prior art briquettes can be achieved but using small cement content together with the same scrap materials of the Si-content of the compound. When the same cement content is used in the invention as in prior art briquettes the strength can be considerably increased. The cement economy amounts to up to 50%. With this cement economy and the large grain surface of the Si-containing materials within the briquette shape, a reduction of slag formation and an advantageous Si-output is obtained.

With admixture of SiC-containing materials, additionally with metallurgical SiC and SiC-containing scrap materials, in greater volume, free amounts of $SiO_2$ are present in the most finely dispersed state. From concrete technology it is known that the addition of finely distributed amounts of $SiO_2$, e.g. quartz sand, to hydraulic binding agents with corresponding pressure and supersaturated steam in a temperature range above 100° C., chemical reactions occur, which give considerably stronger and mechanically resistant products, whereby, at the same time, again, important amounts of cement are saved. The moisture, pressure and temperature used in the method employed according to the invention induce an additional chemical reaction between the binding agent and the $SiO_2$ portion of the SiC materials to form a calcium hydro-silicate (silicate-type effect) which, in the short term, leads to a considerable increase in the strength of the compound and, together with the small proportion of cement, alters the chemical analysis of the briquettes in constrast with other methods. The addition of fine material is technologically a necessity.

Immediately after the hardening process, the briquette already has its ultimate strength, and can be stacked immediately and transported. After-treatment is not necessary.

With this method the advantage is attained that Si-containing scrap materials, which previously were unusable or of only limited use in metallurgical processes can now be put in as silicon bearers.

The method according to the invention can, if desired, be further developed, so that these fine SiC or FeSi materials can also be introduced, as Si-bearers in the Iron and Steel Industry, e.g. in the I.P. method. It has been found advantageous, after hardening, to break the briquette into granules of, e.g. 0–10mm and 10–40mm, somewhere in the ratio of 1 : 3, which ratio can be varied. The binding of the fine material is, by the method of the invention, so intensive that on breaking the briquettes no, or only very little fine material is produced which could cause interference with these metallurgical processes.

An advantageous formulation for the invention of a mix to be processed is as follows:

| | |
|---|---|
| SiC | 60 - 70% |
| $Al_2O_3$ | 2 - 5% |
| CaO | 8 - 10% |
| $SiO_2$ | 15 - 20% |

It will, however, be understood that the exact composition of a briquette produced according to the invention can readily be adapted to the actual metallurgical conditions of the melting processes in which it is to be used.

More specifically a mix of

| | |
|---|---|
| SiC | 62% |
| $SiO_2$ | 17% |
| $Al_2O_3$ | 33% |
| C | 4 to 6% |

shows very good properties in metallurgical processes. The addition of C is not a condition; however the processing of the Si-bearer in the melting process is improved.

What I claim is:

1. A method for the preparation of fine grain metallurgically adjustable silicon bearers containing a material selected from the group consisting of SiC, FeSi, and mixtures thereof having a grain size under 0.2mm, said method comprising the steps of compressing, under a pressure greater than 300 bp/cm$^2$, a thin, moist mix, a fraction of said mix comprising 30–80% SiC or FeSi-containing materials or mixtures thereof, with 10–15% hudraulic binding agent, the remaining silicon-containing fractions having a grain size larger than 0.2mm and hardening the compressed mix in a saturated steam atmosphere above 10 bp/cm$^2$ at a temperature above 100° C.

2. A method according to claim 1, wherein the mix is compressed and hardened to form a briquette.

3. A method according to claim 2, wherein the briquette, after hardening, is broken into two fractions of granular sizes 0–10mm and 10–40mm, the fractions being in the ratio of 1 : 3 respectively.

4. A method according to claim 1, wherein the mix and the product formed therefrom have the composition:

| | |
|---|---|
| SiC | 60 - 70% |
| $Al_2O_3$ | 2 - 5% |
| CaO | 8 - 10% |
| $SiO_2$ | 15 - 20% |

5. A hardened silicon-containing product for metallurgy comprising from 30–85% of material selected from the group consisting of SiC, FeSi-containing materials, and mixtures thereof, having a grain size less than 0.2mm and from 10–15% hydraulic binding agent, the balance, of silicon-containing material having a grain size above 0.2mm.

6. The method according to claim 1, wherein a moist mix comprising 30–35% Si is compressed.

7. The method according to claim 1, wherein a moist mix comprising 30–85% FeSi is compressed.

8. The method according to claim 1, wherein a moist mix comprising 30–85% of a mixture of Si and FeSi is compressed.

9. A product according to claim 5, comprising from 30–85% SiC-containing materials having a grain size less than 0.2mm.

10. A product according to claim 5, comprising from 30–85% FeSi-containing materials having a grain size less than 0.2mm.

11. A product according to claim 5, comprising from 30–85% of a mixture of SiC- and FeSi-containing materials having a grain size less than 0.2mm.

* * * * *